US009184006B2

(12) United States Patent
Tousignant et al.

(10) Patent No.: US 9,184,006 B2
(45) Date of Patent: Nov. 10, 2015

(54) RELAY ACOUSTICAL NOISE REDUCTION SYSTEM

(71) Applicant: Honeywell International Inc., Morristown, NJ (US)

(72) Inventors: Daniel Tousignant, Morristown, NJ (US); Jason Bylinski, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 394 days.

(21) Appl. No.: 13/710,406

(22) Filed: Dec. 10, 2012

(65) Prior Publication Data

US 2014/0160613 A1 Jun. 12, 2014

(51) Int. Cl.

| | |
|---|---|
| ***H01H 9/00*** | (2006.01) |
| ***H01H 47/00*** | (2006.01) |
| ***H01H 51/22*** | (2006.01) |
| ***H01H 51/30*** | (2006.01) |
| ***H01H 47/02*** | (2006.01) |
| ***H01H 47/32*** | (2006.01) |
| *H01H 1/50* | (2006.01) |

(52) U.S. Cl.
CPC ..... *H01H 47/02* (2013.01); *H01H 47/325* (2013.01); *H01H 1/50* (2013.01)

(58) Field of Classification Search
USPC ..... 361/160
See application file for complete search history.

(56) References Cited

U.S. PATENT DOCUMENTS

| | | | | |
|---|---|---|---|---|
| 5,793,252 | A | 8/1998 | Smith | |
| 5,815,364 | A | 9/1998 | Hurley et al. | |
| 5,920,176 | A * | 7/1999 | Blackburn et al. | 318/701 |
| 7,116,541 | B2 * | 10/2006 | Hertz et al. | 361/187 |
| 7,173,488 | B2 | 2/2007 | Smith | |
| 7,483,254 | B1 | 1/2009 | Wang | |
| 2009/0213520 | A1 * | 8/2009 | Bedingfield et al. | 361/154 |
| 2010/0265629 | A1 * | 10/2010 | Beckerman | 361/160 |
| 2012/0120342 | A1 * | 5/2012 | Uchimoto et al. | 349/61 |
| 2012/0167993 | A1 * | 7/2012 | Fedor et al. | 137/12 |
| 2014/0312697 | A1 * | 10/2014 | Landry et al. | 307/64 |

OTHER PUBLICATIONS

Craig W. et al., "Relay Channel Switching-Noisy?", The Cooperative Tube Guitar Amp Project, 6 pages, Printed May 30, 2013, http://www.ax84.com/bbs/dm.php?thread=412436.

* cited by examiner

*Primary Examiner* — Dharti Patel
(74) *Attorney, Agent, or Firm* — Seager, Tufte & Wickhem LLC

(57) ABSTRACT

A system for controlling a relay to reduce acoustic noise of connections and disconnections being made within the relay. An impact of closing and opening contacts in a relay may cause the acoustic noise. For instance, when a relay coil causes the contacts to come together for a connection, an acoustic noise may occur. When the relay coil causes the contacts to separate for breaking a connection, another acoustic noise may occur. Reduction of acoustic noise may be realized by controlling movement of the contacts. The present system may control current to the relay coil to slow the movement of contacts while closing and opening to reduce the acoustic noise.

18 Claims, 4 Drawing Sheets

RELAY ACOUSTICAL NOISE REDUCTION SYSTEM

BACKGROUND

The present disclosure pertains to relays and particularly to control of relays.

SUMMARY

The disclosure reveals a system for controlling a relay to reduce acoustic noise of connections and disconnections being made within the relay. An impact of closing and opening contacts in a relay may cause the acoustic noise. For instance, when a relay coil causes the contacts to come together for a connection, an acoustic noise may occur. When the relay coil causes the contacts to separate for breaking a connection, another acoustic noise may occur. Reduction of acoustic noise may be realized by controlling movement of the contacts. The present system may control current to the relay coil to slow the movement of contacts while closing and opening to reduce the acoustic noise.

DESCRIPTION

The present system and approach, as described herein and/or shown in the Figures, may incorporate one or more processors, computers, controllers, user interfaces, wireless and/or wire connections, and/or the like, wherever desired.

The acoustical noise generated by the relay of a thermostat or another device may annoy users. Requests to manufacturers to create low noise relays having low noise at reasonable costs are not necessarily accepted. For example, one relay having low noise that may be available which is good for limited amperage and sold by allocation. Further, such relay may be a disadvantageous single sourced component.

The present circuit may circumvent various noted issues. The circuit may be used with virtually any regular conventional relay and reduce the acoustical noise of the relay during operation to an acceptable level.

The circuit may control the current that is delivered to the relay by limiting and diverting it. The limiting and diverting current may delay the closing and opening action of the relay and thus reduce the sound emitted by an impact of the contacts with each other or breaking of the contacts. During a breaking of the contacts, at least one contact may spring back to a stop thus making a noise.

With the present circuit in a closing of the relay, a current control circuit may limit the current provided to the coil of the relay for a gradual closing of the contacts. The current control circuit may in effect be used to divert part of the current. As a result, the speed and the impact of the contacts may be reduced and thus reduce or minimize an acoustic noise of the closing contacts.

For opening the relay, a current control circuit may be utilized to keep the current flowing through the coil to the relay, in which the current may be slowly reduced in magnitude for a gradual opening of the contacts. The gradual opening of the contacts may reduce or minimize an acoustic noise of the opening contacts.

Relay contacts may be opened or closed with an application of current to a relay coil affecting the contacts. Likewise, relay contacts may be opened or closed with a removal of current from the relay coil affecting the contacts. An illustrative example described herein may have relay contacts that close upon an application of current to the relay coil and have relay contacts that open upon removal of current from the relay coil.

Figure 1:
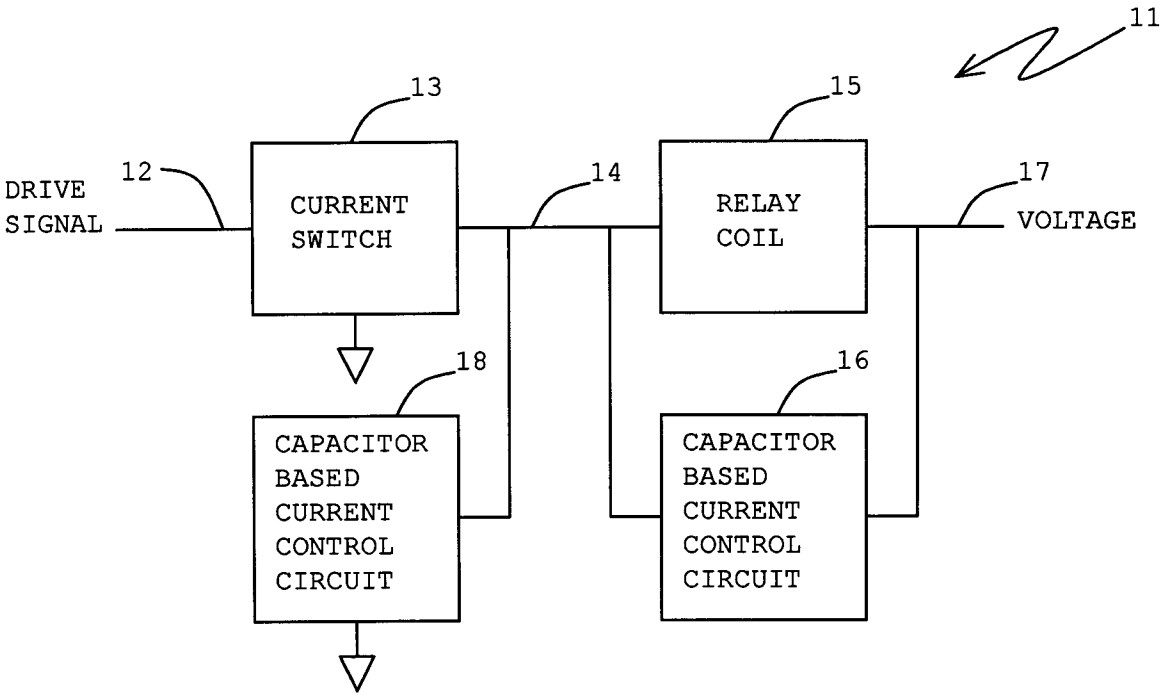
FIG. 1 is a block diagram of an example system for controlling a relay.

FIG. 1 is a block diagram 11 of the present circuit. A drive signal may be provided on a line 12 to a current switch 13. Current switch 13 may be connected to a relay coil 15 via a line 14. A capacitor based current control circuit 18 may be connected to line 14. A capacitor based current control circuit 16 may be connected to lines 14 and 17.

Figure 2:
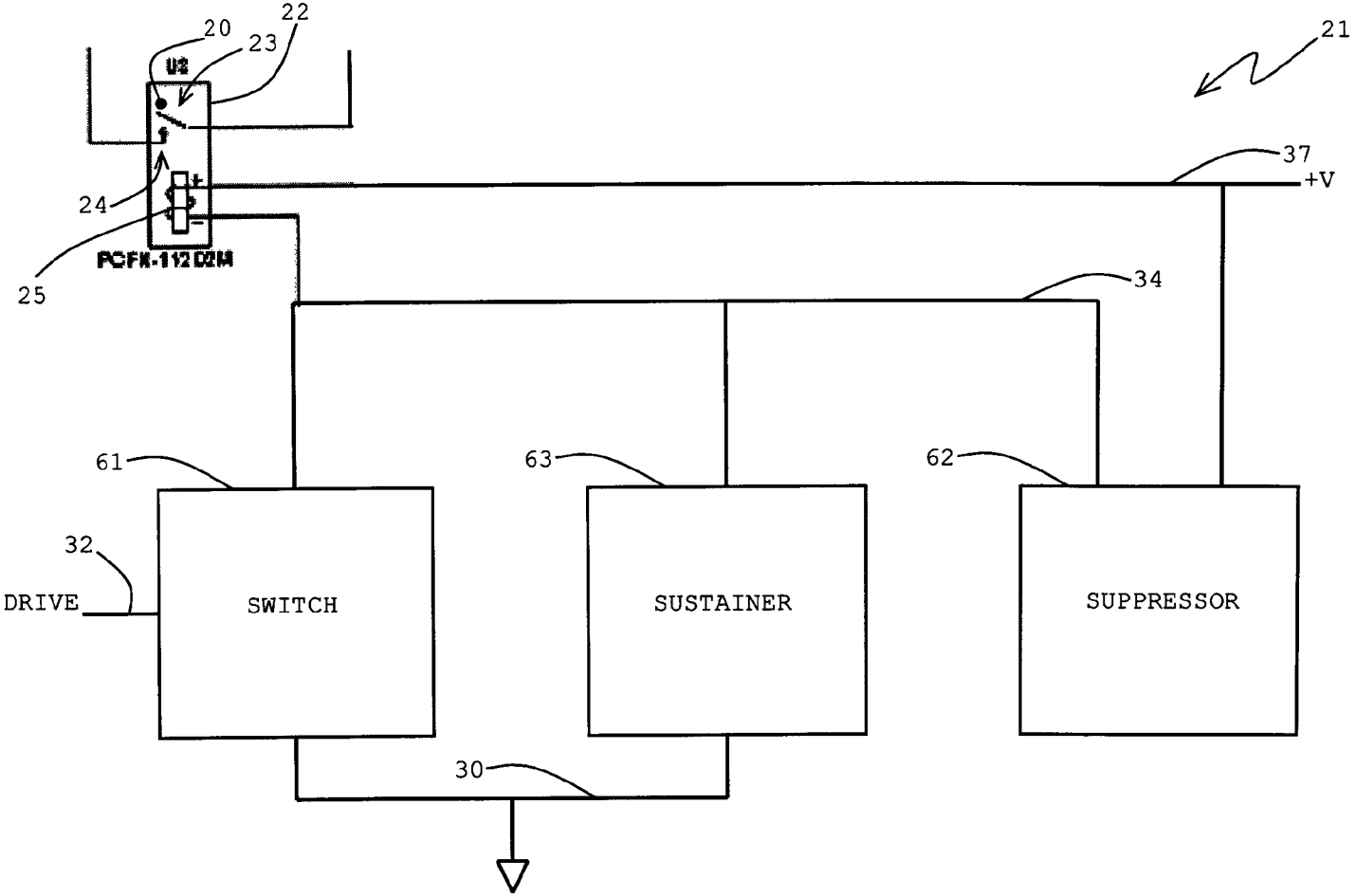
FIG. 2 is a diagram outlining the major components of the system.

FIG. 2 is a diagram outlining the major components of an example of a present circuit 21. A switch 61 may have an input for a drive signal. Switch 61 may have a line 34 that is connected to one end of a coil 25 of relay 22. Coil 25 may have another end connected to a polarity of voltage source via line 37. Switch 61 may connect line 34 to another polarity, ground or reference terminal 30 (ground) of the voltage source to result in a current flow through coil 25 so as to close or bring contacts 23 and 24 in connection with each other. Switch 61 may also disconnect line 34 from ground 30 to result in a ceasing of current flow through coil 25 so as for contacts 23 and 24 to break away and disconnect from each other. In relay 22, contact 23 may be drawn into connection with contact 24 with a magnetic force of coil 25 caused by current flow through the coil, Contact 24 may be stationary relative to coil 25 and a structure of relay 22. Contact 23 may have spring-like tension which causes contact 23 to be apart from contact 24 when not subject to a magnetic force of coil 25. When contact 23 breaks away form contact 24, contact 23 may move back to a stop 20. When contact 23 impacts stop 20, there may be an acoustic noise from the impact. Similarly, when contact 23 is drawn to an impact with contact 24 by a magnetic force from coil 25, there may be an acoustic noise from the impact. A configuration of relay 22 shown in the Figures of the present description is merely an illustrative example. Relay 22 may have various configurations with many kinds of assortments of contacts and arrangements of a relay coil or coils, or other magnetic force producing mechanisms. An example relay 22 may be a PCFN-112D2M. This relay may be available at vendors of electronic parts.

FIG. 2 shows a sustainer 63, connected between line 34 and ground 30, which may sustain the current through coil 25 when switch 61 disconnects coil 25 from electrical power. With current to coil 25 being sustained for a period of time, though at a magnitude decreasing from an original magnitude provided by switch 61 to coil 25, contacts 23 and 24 may open with smaller impact and less acoustic noise than the impact and noise if the current were not sustained. A suppressor 62, connected between line 34 and line 37, may hinder a full magnitude of current being provided to coil 25 by switch 61 when connecting coil 25 to the electrical power. Suppressor 62 may shunt or bypass some of the current when initially provided to coil 25 by switch 61. With current to coil 25 being suppressed for a period of time, though resulting in an increasing magnitude to coil 25, contacts 23 and 24 may close with a smaller impact and less acoustic noise than the impact and noise if the current were not suppressed.

Figure 3:
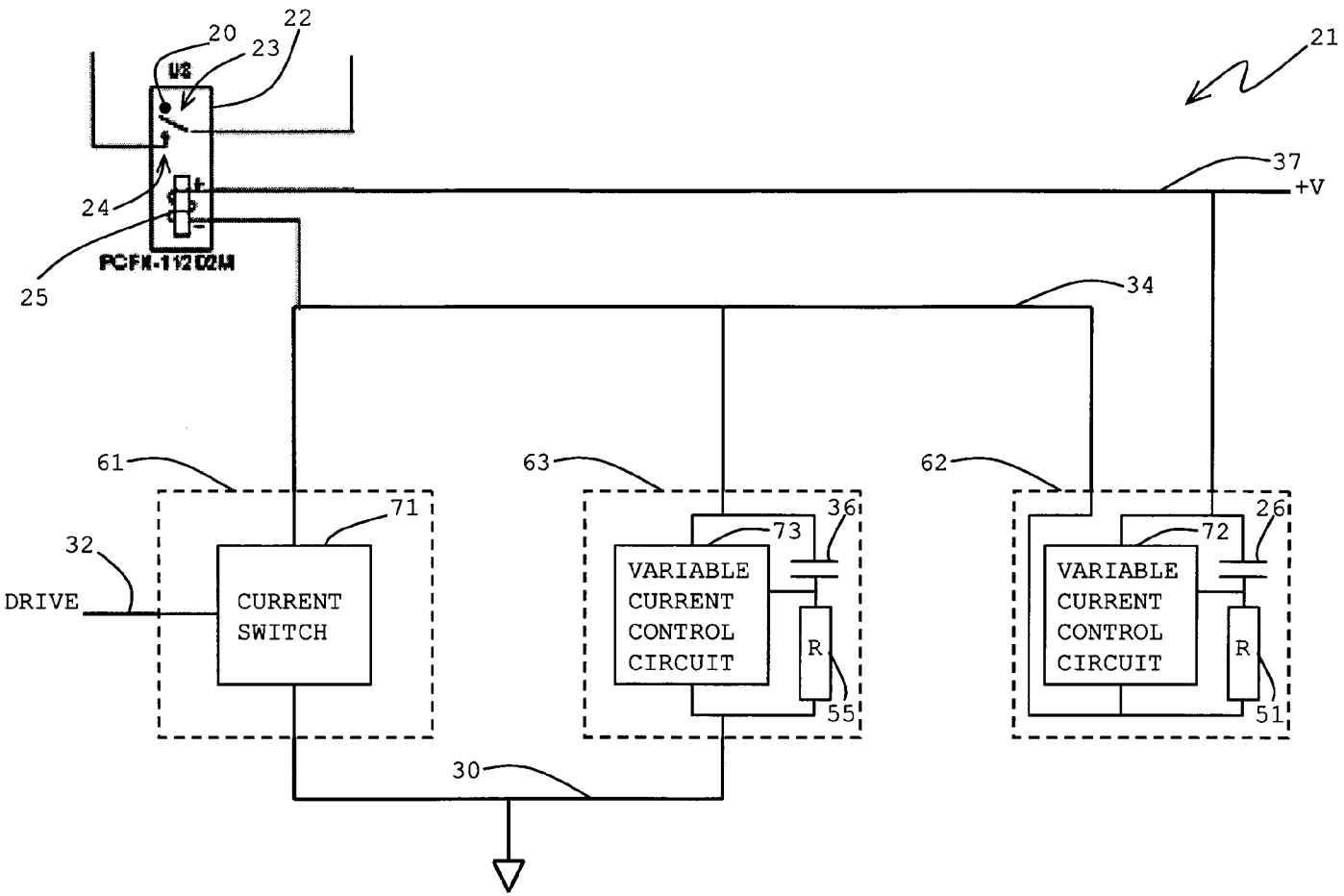
FIG. 3 is a diagram of the system showing some details of the major components.

FIG. 3 is a diagram of circuit 21 showing more detail relative to the diagram of FIG. 2. Switch 61 may have a current switch 71. Sustainer 63 may have a variable current control circuit 73 connected to a circuit having a capacitor 36 and a resistor 55. Suppressor 62 may have a variable current control circuit 72 connected to a circuit having a capacitor 26 and a resistor 51.

Figure 4:
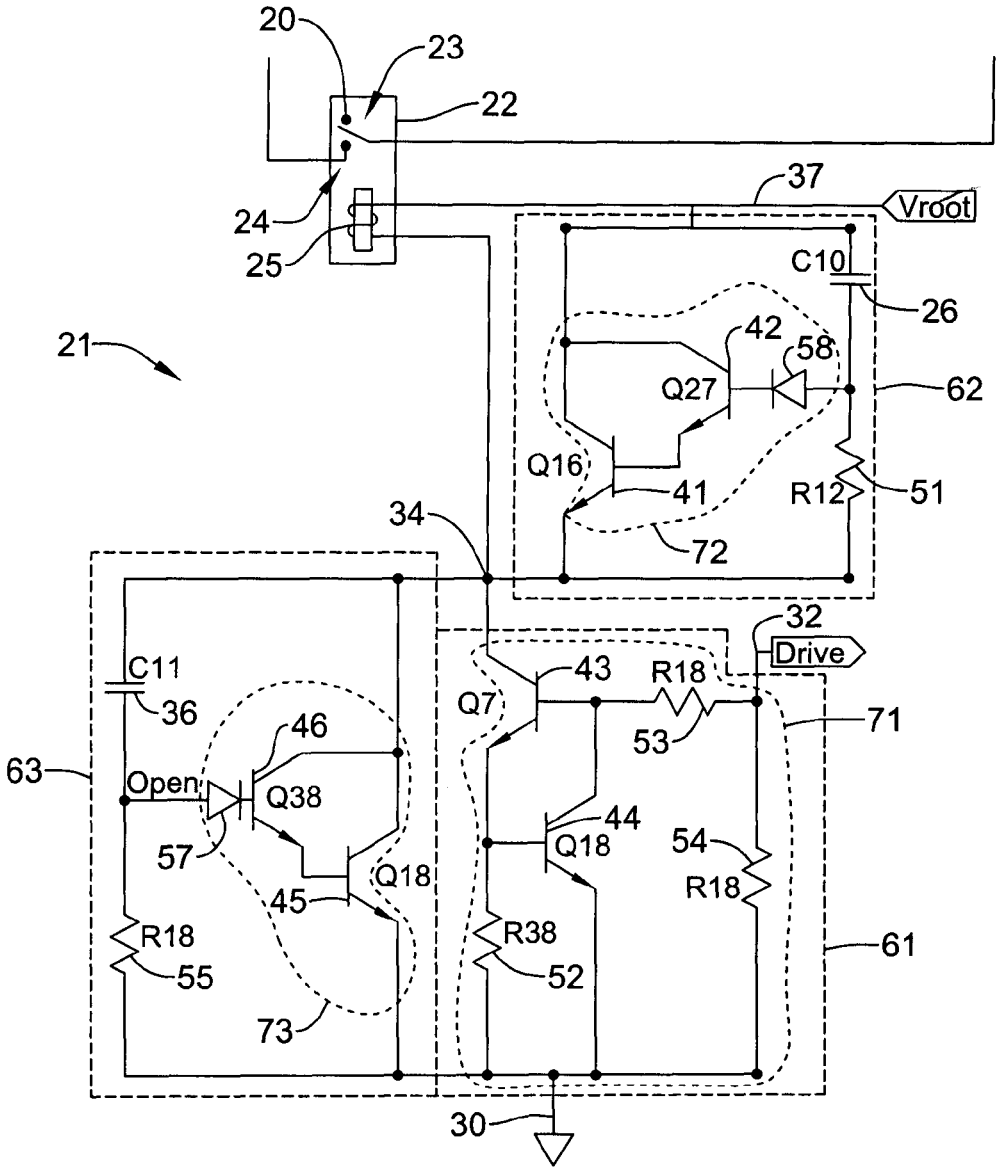
FIG. 4 is a diagram of a schematic of an example circuit for the system.

FIG. 4 is a diagram of a schematic of circuit 21. The schematic is an illustrative example of circuit 21. Circuit 21 may be implemented with other layouts of various components. Transistors in the circuit may be 2N3904 transistors. The diodes may be 1N4148 diodes. These components may be available at vendors of electronic parts. Other kinds of transistors, diodes or components may be used. The values of the capacitors and resistors may be other than those as indicated in the schematic.

To begin, groupings of the components in the schematic may be noted according to the diagram of FIG. 3. Current switch 71 of switch 61 may have transistors 43 and 44 and resistors 52-54. Variable current control circuit 73 of sustainer 63 may have transistors 45 and 46. Variable current control circuit 72 of suppressor 62 may have transistors 41 and 42. Additional connections and description of components may be provided herein.

Line 37 may be connected to a voltage and to a positive terminal of relay coil 25. A negative terminal of relay coil 25 may be connected to a line 34. An NPN transistor 41 may have a collector connected to line 37 and an emitter connected to line 34. An NPN transistor 42 may have a collector connected to line 37 and an emitter connected to a base of transistor 41. A capacitor 26 may have a first terminal connected to line 37 and a second terminal connected to a base of transistor 42 via a diode 58 having an anode connected to the second terminal of capacitor 26 and a cathode connected to the base of transistor 42. Diode 58 may be for a protection purpose. Capacitor 26 may have a value of about 0.47 microfarads. A 51K ohm resistor 51 may have first end connected to the anode of diode 58, and a second end connected to line 34. A voltage or signal on the base of transistor 42 may control a closing of relay contacts 23 and 24.

An NPN transistor 43 may have a collector connected to line 34 and an emitter connected via a 2.2 ohm resistor 52 to a ground or zero voltage reference line 30. A drive signal line 32 may be connected to a first end of a 1K ohm resistor 53. A second end of resistor 53 may be connected to a base of transistor 43. A collector of an NPN transistor 44 may be connected to the base of transistor 43. An emitter of transistor 44 may be connected to line 30. A base of transistor 44 may be connected to the emitter of transistor 43. Line 32 may also be connected to a first end of a 51K ohm resistor 54. A second end of resistor 54 may be connected to line 30.

An NPN transistor 45 may have a collector connected to line 34 and an emitter connected to line 30. An NPN transistor 46 may have a collector connected to line 34 and an emitter connected to a base of transistor 45. A 2.2 microfarad capacitor 36 may have a first terminal connected to line 34 and a second terminal connected to an anode of diode 57. A cathode of diode 57 may be connected to the base of transistor 46. Diode 57 is for a protection purpose. A 51K ohm resistor 55 may have a first end connected to the base of transistor 46 and a second end connected to line 30. A voltage or signal on the base of transistor 46 may control an opening of relay contacts 23 and 24.

At a steady state where the voltage of a drive signal at line 32 is low, transistors 43 and 44 may be off. The voltage on line 34 may be somewhat higher than ground 30. Transistors 45 and 46 may be off since capacitor 36 would be charged and the base to transistor 46 would be pulled down by resistor 55. So line 34 may float up towards the voltage level on line 37. Transistors 41 and 42 would be off in this steady state since capacitor 26 would be discharged through resistor 51 and the base of transistor 42 would be close to the voltage of the emitter of transistor 41.

As the drive signal at line 32 goes up, transistors 43 and 44 go on pulling the voltage down and line 34 as current flows from line 34 to line 30. This should pull current through the relay; however, as the emitter voltage of transistor 41 is pulled down, transistors 42 and 41 will tend to turn on since the base voltage will be held higher from the emitter voltage until capacitor 26 charges current through resistor 51 and the base of transistor 42. While transistor 41 is on, current may be shunted or bypassed from coil 25 causing contacts 24 and 25 to be slowed down in closing thereby reducing acoustic noise of the contacts closing. As capacitor 26 is completely charged, transistor 41 will be off and current flow through coil 25 will be sufficient for contacts 23 and 24 to be closed when a steady state of the circuit 21 is reached.

At the steady state where the voltage of a drive signal on line 32 is high, transistors 43 and 44 may remain turned on and the voltage on line 34 may be close to voltage 30 except for a small voltage drop through resistor 52. With a low voltage across transistors 45 and 46, and resistor 55 discharging capacitor 36 having pulled the base of transistor 46 down to a voltage level of line 30, transistors 45 and 46 may be regarded as being turned off. Also, as noted above, transistors 41 and 42 may be regarded as being turned off since the base of transistor 42 is pulled down by resistor 51, having charged capacitor 26, to a voltage level between line 37 and base of transistor 42.

When drive signal on line 32 goes down, transistors 43 and 44 may turn off and stop conducting current from coil 25. The voltage on line 34 will tend to go up which may result in transistor 45 and 46 to be turned on since the voltage on the terminal of capacitor 36 is connected to line 34, and the other terminal of capacitor 36 is connected to the base of transistor 46. Line 34 is raised in voltage sufficient to keep transistors 46 and 45 on thereby resulting in a continued flow of current through coil 25 and preventing a sudden opening of contacts 23 and 24. However, as resistor 55 and transistor 46 and 45 charges capacitor 36, the voltage of line 34 goes up reducing the voltage across coil 25 thereby reducing the current flowing through coil 25 and resulting in a gradual opening of contacts 23 and 24 and a reduction of acoustic noise of the contacts. The voltage level on line 34 may reach the level on line 37 as circuit 21 approaches a steady state with the drive signal on line 32 at a low level.

To recap, an approach, for reducing contact noise in a relay, may incorporate restraining movement of one or more contacts relative to another one or more contacts of a relay upon a connection or disconnection of a source of current to a coil of the relay to reduce contact noise. Restraining movement of the one or more contacts relative to the other one or more other contacts upon the connection of the source of current may incorporate diverting a portion of an initial current destined for the coil for a first period of time. Restraining movement of the one or more contacts relative to the other one or more other contacts upon the disconnection of the source of current may incorporate continuing a portion of a final current to the coil for a second period of time.

The connection or disconnection of the source to the coil may be provided by a switch connected to the source of current and to the coil.

The first period of time may be provided by a time constant of a first resistive capacitive circuit. The second period of time may be provided by a time constant of a second resistive capacitive circuit.

Diverting a portion of the initial current destined for the coil may be accomplished by a circuit connected in parallel with the coil that begins with a conductance sufficient to conduct some of the current that would otherwise be conducted by the coil upon the connection of the source of current to the coil. Continuing a portion of the final current to the coil may be accomplished by a circuit connected in parallel with the switch that begins with a conductance sufficient to conduct some of the current that was otherwise conducted by the switch before the disconnection of the source of current.

A magnitude of a diverted portion of the initial current destined for the coil may varies from a first value to a second value during the first period of time. A magnitude of a continued portion of the final current to the coil may vary from a third value to a fourth value. The first value may be equal to or greater than the second value. The third value may be equal to or greater than the fourth value.

A relay contact noise reduction system may incorporate a switch connected to a relay, a suppressor connected to the relay, and a sustainer connected to the relay. The suppressor may hinder current flow to the relay upon a connection of current from the switch to the relay for a first predetermined period of time. The sustainer may maintain a current flow to the relay upon disconnection of current from the switch to the relay for a second predetermined amount of time.

Hindering current flow in the relay upon connection of current from the switch to the relay may reduce noise caused by relay contacts coming in contact with each other. Maintaining current flow in the relay upon disconnection of current from the switch to the relay may reduce noise caused by relay contacts breaking contact from each other.

The first predetermined amount of time may be based on a time constant of a resistor and capacitor circuit. The second predetermined amount of time may be based on a time constant of a resistor and capacitor circuit.

The suppressor may hinder the current flow but with an increasing magnitude of the current during the first determined amount of time. The sustainer may maintain the current flow but with a decreasing magnitude of the current during the second determined amount of time.

The suppressor may incorporate a first variable current control circuit, and a first resistor capacitor circuit connected to an input of the first variable current control circuit. The sustainer may incorporate a second variable current control circuit, and a second resistor capacitor circuit connected to an input of the second variable current control circuit.

The current switch may connect and disconnect a voltage supply to the relay. The suppressor may divert current from the relay during an initial connection of the voltage supply to the relay. The sustainer may provide current to the relay during an initial disconnection of the voltage supply from the relay.

Hindering current flow in the relay upon connection may reduce a speed of the relay contacts coming into connection with each other. Maintaining current flow in the relay upon disconnection of current from the switch to the relay may reduce a speed of relay contacts breaking from each other.

A relay acoustical noise reduction circuit may incorporate a current switch having a connection for a drive signal and a connection to a coil of a relay having at least one pair of contacts, and a first capacitor based current control circuit having a connection to the coil of the relay. The first capacitor based current control circuit may minimize acoustic noise of a pair of contacts by controlling current to the coil of the relay.

The drive signal may be a voltage that has a first magnitude to close the relay and a second magnitude to open the relay. To close the relay may be to bring a pair of contacts in contact with each other. To open the relay may be to separate a pair of contacts from contact with each other.

The relay acoustical noise reduction circuit may further incorporate a second capacitor based current control circuit having a connection to the coil of the relay. The first capacitor based current control circuit may sustain a current flow through the coil for a first period of time after the current switch receives the voltage having the second magnitude to open the relay. The second capacitor based current control circuit may suppress a current flow through the coil for a second period of time after the current switch receives the voltage having the first magnitude to close the relay.

The first period of time may be determined by a time constant of a first capacitance and a first resistance. The second period of time may be determined by a time constant of a second capacitance and a second resistance.

When the current switch discontinues a flow of current in the coil, the first capacitor based current control circuit may sustain a flow of current at a first magnitude that decreases during the first period of time to a second magnitude.

When the current switch begins a flow of current in the coil, the second capacitor based current control circuit may suppress the flow of current at a first magnitude that increases during the second period of time to a second magnitude.

The first capacitor based current control circuit may sustain the current flow through the coil for the first period of time after the current switch receives the voltage having the second magnitude to open the relay, to permit contacts of the relay to break away from each other slowly to minimize acoustic noise of the contacts.

The second capacitor based current control circuit may suppress a current flow through the coil for the second period of time after the current switch receives the voltage having the first magnitude to close the relay, to permit contacts of the relay to come together slowly to minimize acoustic noise of the contacts.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A method for reducing contact noise in a relay, comprising:

restraining movement of one or more contacts relative to another one or more contacts of a relay upon a connection or disconnection of a source of current to a coil of the relay to reduce contact noise; and wherein:

restraining movement of the one or more contacts relative to the other one or more other contacts upon the connection of the source of current comprises diverting a portion of an initial current destined for the coil for a first period of time; and restraining movement of the one or more contacts relative to the other one or more other contacts upon the disconnection of the source of current comprises continuing a portion of a final current to the coil for a second period of time.

2. The method of claim 1, wherein the connection or disconnection of the source to the coil is provided by a switch connected to the source of current and to the coil.

3. The method of claim 1, wherein:
the first period of time is provided by a time constant of a first resistive capacitive circuit; and
the second period of time is provided by a time constant of a second resistive capacitive circuit.

4. The method of claim 1, wherein:
diverting a portion of the initial current destined for the coil is accomplished by a circuit connected in parallel with the coil that begins with a conductance sufficient to conduct some of the current that would otherwise be conducted by the coil upon the connection of the source of current to the coil; and
continuing a portion of the final current to the coil is accomplished by a circuit connected in parallel with the switch that begins with a conductance sufficient to conduct some of the current that was otherwise conducted by the switch before the disconnection of the source of current.

5. The method of claim 1, wherein:
a magnitude of a diverted portion of the initial current destined for the coil varies from a first value to a second value during the first period of time; and
a magnitude of a continued portion of the final current to the coil varies from a third value to a fourth value;
the first value is equal to or greater than the second value; and
the third value is equal to or greater than the fourth value.

6. A relay contact noise reduction system comprising:
a switch connected to a relay;
a suppressor connected to the relay; and
a sustainer connected to the relay; and
wherein:
the suppressor hinders current flow to the relay upon a connection of current from the switch to the relay for a first predetermined period of time; and
the sustainer maintains a current flow to the relay upon disconnection of current from the switch to the relay for a second predetermined amount of time.

7. The system of claim 6, wherein:
hindering current flow in the relay upon connection of current from the switch to the relay reduces noise caused by relay contacts coming in contact with each other; and
maintaining current flow in the relay upon disconnection of current from the switch to the relay reduces noise caused by relay contacts breaking contact from each other.

8. The system of claim 6, wherein:
the first predetermined amount of time is based on a time constant of a resistor and capacitor circuit; and
the second predetermined amount of time is based on a time constant of a resistor and capacitor circuit.

9. The system of claim 8, wherein:
the suppressor hinders the current flow but with an increasing magnitude of the current during the first determined amount of time; and
the sustainer maintains the current flow but with a decreasing magnitude of the current during the second determined amount of time.

10. The system of claim 6, wherein:
the suppressor comprises:
a first variable current control circuit; and
a first resistor capacitor circuit connected to an input of the first variable current control circuit; and
the sustainer comprises:
a second variable current control circuit; and
a second resistor capacitor circuit connected to an input of the second variable current control circuit.

11. The system of claim 6, wherein:
the current switch connects and disconnects a voltage supply to the relay;
the suppressor diverts current from the relay during an initial connection of the voltage supply to the relay; and
the sustainer provides current to the relay during an initial disconnection of the voltage supply from the relay.

12. The system of claim 6, wherein:
hindering current flow in the relay upon connection reduces a speed of the relay contacts coming into connection with each other; and
maintaining current flow in the relay upon disconnection of current from the switch to the relay reduces a speed of relay contacts breaking from each other.

13. A relay acoustical noise reduction circuit comprising:
a current switch having a connection for a drive signal and a connection to a coil of a relay having at least one pair of contacts;
a first capacitor based current control circuit having a connection to the coil of the relay; and
wherein:
the first capacitor based current control circuit minimizes acoustic noise of a pair of contacts by controlling current to the coil of the relay;
the drive signal is a voltage that has a first magnitude to close the relay and a second magnitude to open the relay;
to close the relay is to bring a pair of contacts in contact with each other;
to open the relay is to separate a pair contacts from contact with each other; and
the circuit further comprises:
a second capacitor based current control circuit having a connection to the coil of the relay; and
wherein:
the first capacitor based current control circuit sustains a current flow through the coil for a first period of time after the current switch receives the voltage having the second magnitude to open the relay; and
the second capacitor based current control circuit suppresses a current flow through the coil for a second period of time after the current switch receives the voltage having the first magnitude to close the relay.

14. The circuit of claim 13, wherein:
the first period of time is determined by a time constant of a first capacitance and a first resistance; and
the second period of time is determined by a time constant of a second capacitance and a second resistance.

15. The circuit of claim 13, wherein when the current switch discontinues a flow of current in the coil, the first capacitor based current control circuit sustains a flow of current at a first magnitude that decreases during the first period of time to a second magnitude.

16. The circuit of claim 13, wherein when the current switch begins a flow of current in the coil, the second capacitor based current control circuit suppresses the flow of current at a first magnitude that increases during the second period of time to a second magnitude.

17. The circuit of claim 13, wherein the first capacitor based current control circuit sustains the current flow through the coil for the first period of time after the current switch receives the voltage having the second magnitude to open the relay, to permit contacts of the relay to break away from each other slowly to minimize acoustic noise of the contacts.

18. The circuit of claim 13, wherein the second capacitor based current control circuit suppresses a current flow through the coil for the second period of time after the current switch receives the voltage having the first magnitude to close the relay, to permit contacts of the relay to come together slowly to minimize acoustic noise of the contacts.

* * * * *